US006287195B1

(12) United States Patent
Sugimoto et al.

(10) Patent No.: US 6,287,195 B1
(45) Date of Patent: Sep. 11, 2001

(54) GAME MACHINE WITH BET NUMBER DESIGNATING MEANS

(75) Inventors: Kiyoshi Sugimoto; Tomio Komori; Masaki Yoshizawa, all of Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/251,332

(22) Filed: Feb. 17, 1999

(30) Foreign Application Priority Data

Feb. 17, 1998 (JP) ..... 10-051382

(51) Int. Cl.[7] ..... G07F 17/34
(52) U.S. Cl. ..... 463/20; 273/143 R; 463/25
(58) Field of Search ..... 273/143 R, 138.1, 273/138.2; 463/25, 29; 235/78 G, 88 G; 340/825

(56) References Cited

U.S. PATENT DOCUMENTS 5,113,990 * 5/1992 Gabrius et al. ..... 194/206
5,813,511 * 9/1998 Takemoto et al. ..... 194/217

FOREIGN PATENT DOCUMENTS 07108080 4/1995 (JP) .
08117389 5/1996 (JP) .

* cited by examiner

*Primary Examiner*—Benjamin H. Layno
(74) *Attorney, Agent, or Firm*—Pillsbury Winthrop LLP

(57) ABSTRACT

To set a bet number according to an intention of a player, there is provided one bet switch 12 for a player to designate a desired bet number N. A game machine is provided in its body with a control unit 23 for setting the bet number N designated by the player by detecting whether or not the bet switch 12 has been operated. This control unit 23 sets the bet number N to a maximum allowable bet number "Kmax" when the bet switch 12 is operated one time prior to the start of each game. After this, each time the bet switch 12 is operated, the maximum allowable bet number "Kmax" is subtracted by 1, and this difference is set as the bet number N. Each time the operation number of the bet switch 12 reaches a predetermined value, the maximum allowable bet number is again set to "Kmax". By repeating the subtraction of the bet number N by 1 each time the bet switch 12 is operated, moreover, the bet number N is set within a range of the maximum allowable bet number "Kmax".

9 Claims, 6 Drawing Sheets

Fig. 6

| Prize Mode / Bet Number | Big | Regular | Small | | | | |
|---|---|---|---|---|---|---|---|
| | BB | RB | Water melon | Bell | 4 Cherry | 2 Cherry | Replay |
| 1 | a 1 | b 1 | c 1 | d 1 | e 1 | f 1 | g 1 |
| 2 | a 2 | b 2 | c 2 | d 2 | e 2 | f 2 | g 2 |
| 3 | a 3 | b 3 | c 3 | d 3 | e 3 | f 3 | g 3 |

GAME MACHINE WITH BET NUMBER DESIGNATING MEANS

This patent application claims priority based on the Japanese patent application, H10-51382 filed on Feb. 17, 1998 the contents of which are incorporated herein by reference.

BACKGROUND OF THE INVENTION

1. Field of the Invention

The present invention relates to a game machine which is enabled to designate a desired bet number within a range of the maximum allowable bet number merely by operating bet number designating means by a player in place of inserting game media such as game coins.

2. Description of Related Art

In the prior art, the game machine of this kind is exemplified by a slot machine. In an ordinary slot machine, the game coins can be bet up to the upper limit of a predetermined maximum allowable bet number. This maximum allowable bet number is limited within three for an ordinary game and is limited to one for a high bonus game.

When the player inserts one to three game coins into a coin slot, one or more winning lines are effected according to the bet number. When a game start lever is operated by the player, three rotary cylinders (as will be called the "reels") are rotated altogether to start the game. When the player then depresses stop button switches provided for the individual reels, all these reels are stopped. A prize is awarded when predetermined symbols of the individual reels are arrayed on the effective winning line, so that a predetermined number of game coins are awarded according to the combination of the symbols.

However, the insertion of the game coins into the slot for each game troubles the player who is going to continue a plurality of games. Therefore, the slot machine is provided with a reservoir coin insertion button switch (as will be also called the "bet switch") which can designate the bet number on the basis of the game coins reserved in coin reservoir means in place of the actual insertion of the game coins. This slot machine is known as a slot machine having one bet switch or a slot machine having a plurality of bet switches.

In the slot machine having one bet switch, the bet number is set to "1", when the player depresses the bet switch one time, to "2", when the bet switch is depressed continuously two times, and to "3" when the same is depressed continuously three times. Therefore, the bet switch of the slot machine can be called the depression number counting type capable of counting up the bet number according to the depression number.

In the slot machine having a plurality of bet switches, a predetermined bet number is assigned in advance to each bet switch. This assignment enables the player to bet one coin, when he depresses the bet switch dedicated to the bet number "1", to bet two coins, when the bet switch dedicated to the bet number "2" is depressed, and to bet three coins when the bet switch dedicated to the bet number "3" is depressed.

On the other hand, the slot machine having a plurality of bet switches is exemplified by one having two bet switches: the depression number counting type bet switch; and the dedicated bet switch to which the maximum allowable bet number is assigned in advance. In this slot machine, the bet number can be designated with the number of depressions of the bet switch of the depression number counting type, and the maximum allowable bet number can be designated not only by depressing the dedicated bet switch but also by depressing the bet switch of the depression number counting type a predetermined number of times.

However, the game machine of the prior art presents following problems. If the maximum allowable bet number is designated, the prize probability is also at its maximum. It is, therefore, common for the player to start the game by designating the maximum allowable bet number. Considering this intention of the player, the game machine having one bet switch of the depression number counting type requires a plurality of depressions for designating the maximum allowable bet number. Thus, this depression for each game may be and burdensome to the player.

The aforementioned game machine having the three dedicated bet switches has the disadvantage of increasing the number of parts because of the increase in the number of bet switches.

On the other hand, the slot machine having the bet switch of the depression number counting type and the dedicated bet switch is also problematic due to the increase in the number of parts.

SUMMARY OF THE INVENTION

The invention has been conceived to solve the aforementioned problems of the prior art and to provide a game machine capable of setting a bet number with a small number of parts and in conformity with the intention of a player.

In order to achieve this object, according to the invention, there is provided a game machine enabling a player to designate a bet number within a range of a predetermined maximum allowable bet number, which machine comprises: one bet number designating means operated when the player designates a bet number; and control means for setting the bet number to the maximum allowable bet number for each game in response to a first operation of the bet number designating means.

According to this construction, when the bet number designating means is operated for each game, the bet number is set to the maximum allowable bet number in response to the first operation. Therefore, this construction can match the intention of the player who is going to start the game by designating the maximum allowable bet number, and can lighten the burden on the player.

According to the invention, on the other hand, the control means decreases the bet number which is set in response to the first operation of the bet number designating means, each time the number of operations of the bet number designating means increases.

According to this construction, for each game, the bet number is set to the maximum allowable bet number in response to the first operation of the bet number designating means, and the bet number is reduced for each increase in the number of operations of the bet number designating means so that the bet number is set within a range up to the upper limit of the maximum allowable bet number. As a result, it is possible to match the intention of the player and to set a bet number other than the maximum allowable bet number.

According to the invention, on the other hand, in each game, the control means decreases the bet number, which has been set in response to the first operation of the bet number designating means, each time the number of operations of the bet number designating means increases, and sets the bet number again to the maximum allowable bet number when the operation number reaches a predetermined value, to repeat the operation to decrease the bet number each time the operation number of the bet number designating means increases.

According to this construction, in each game, the bet number is set to the maximum allowable bet number in response to the first operation of the bet number designating means and is reduced each time the operation number of the bet number designating means increases. When the operation number reaches the predetermined value, the bet number is set again to the maximum allowable bet number. After this, the bet number is decreased each time the operation number of the bet number designating means increases, and a similar routine is repeated. Thus, the bet number is repeatedly set within the range up to the maximum bet number. As a result, it is possible to match the intention of the player, to set a bet number other than the maximum bet number and to reset the bet number.

By operating only one bet number designating means, on the other hand, a plurality of different bet numbers can be set to realize a game machine having a small number of parts.

Moreover, it is sufficient to detect the signal coming from only one bet number designating means, so that the program operations relating to the bet flag or the like can be simplified with a smaller memory capacity.

According to the invention, on the other hand, the maximum allowable bet number is set in relation to the number of residuals reserved by coin reservoir means.

According to this construction, the residual credit number can be automatically detected, although the player fails to remember it, to set the bet number according to the credit number. Moreover, coins of a number over the credit limit are prevented from being inserted.

BRIEF DESCRIPTION OF THE DRAWINGS

FIG. 6 is an explanatory diagram conceptionally showing a construction of a prize probability table stored in a ROM shown in FIG. 3.

DESCRIPTION OF THE PREFERRED EMBODIMENT

Figure 1:
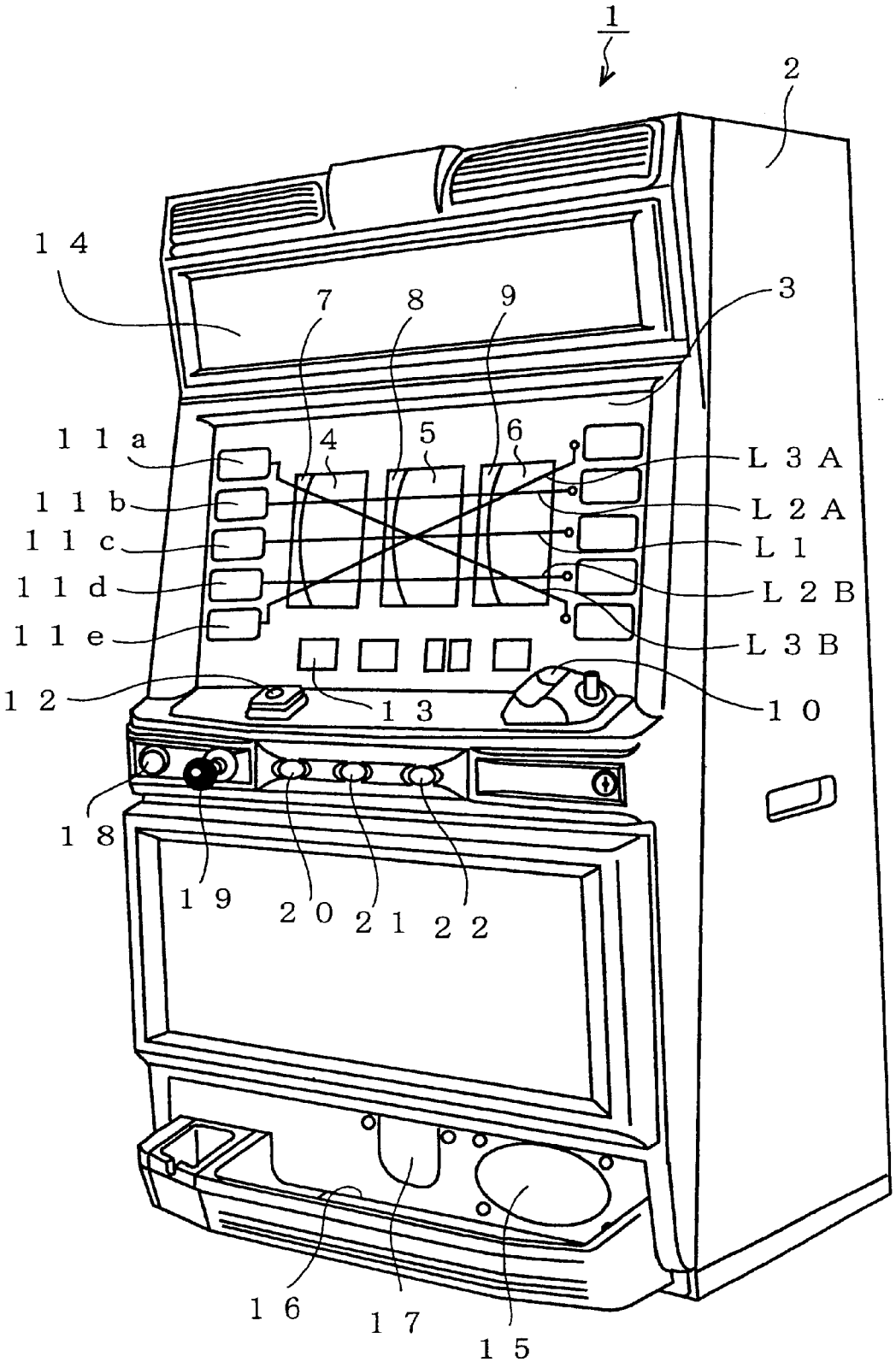
FIG. 1 is a perspective view showing an external structure of a slot machine according to an embodiment of the invention.

Here will be described one embodiment in which a game machine according to the invention is applied to a slot machine. FIG. 1 presents a perspective view, as taken obliquely from the front, of a slot machine 1 according to this embodiment.

In FIG. 1, the slot machine 1 is provided at its casing 2 with a front panel 3 facing the player. At the back of this front panel 3, there are rotatably mounted three reels 4, 5 and 6 which construct variable display means. On the outer circumference of each of the reels 4, 5 and 6, there is illustrated a symbol column which is composed of a plurality of patterns (as will be called the "symbols"). Three of these symbols are observed through display windows 7, 8 and 9 which are opened in the front face of the front panel 3.

On the lower righthand side of the display window 9, there is opened a slot 10 for inserting a game coin therethrough. The game coin, as inserted into the slot 10, is detected by a coin sensor and is stored in a reservoir hopper while increasing the storage number (or credit number) of coin reservoir means. Here, these coin sensor and the reservoir hopper are arranged in the casing 2.

In the display windows 7, 8 and 9, there are illustrated three horizontal winning lines L1, L2A and L2B and two oblique winning lines L3A and L3B. On the lefthand side of the display window 7, there are provided five effective line display lamps 11*a* to 11*e* corresponding to the individual winning lines L1, L2A, L2B, L3A and L3B.

Figure 2A:
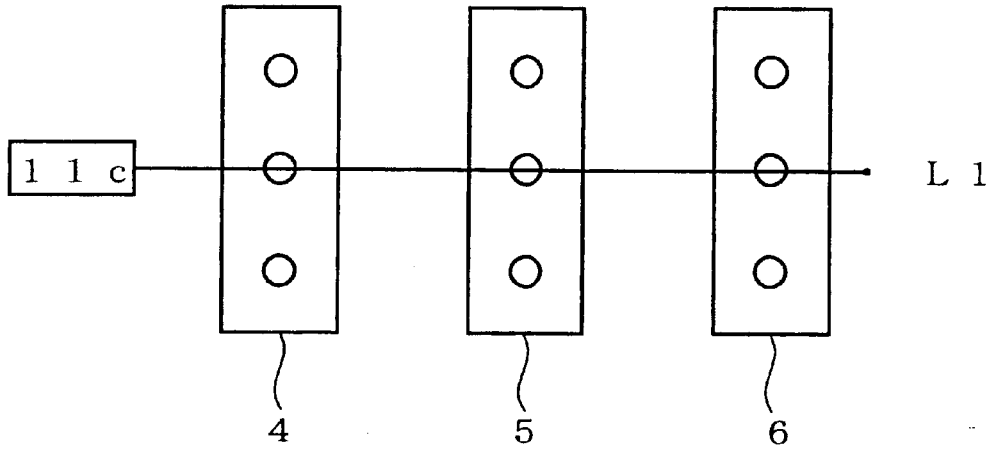
FIGS. 2A, 2B and 2C are diagrams showing the states in which the winning lines drawn in the display windows of the slot machine of FIG. 1 are sequentially activated.

When the player inserts one game coin into the slot 10 prior to the start of each game, the bet number is "1". As shown in FIG. 2A, the center winning line L1 over the individual reels 4 to 6 is then exclusively activated so that the effective line display lamp 11*c* is lighted.

Figure 2B:
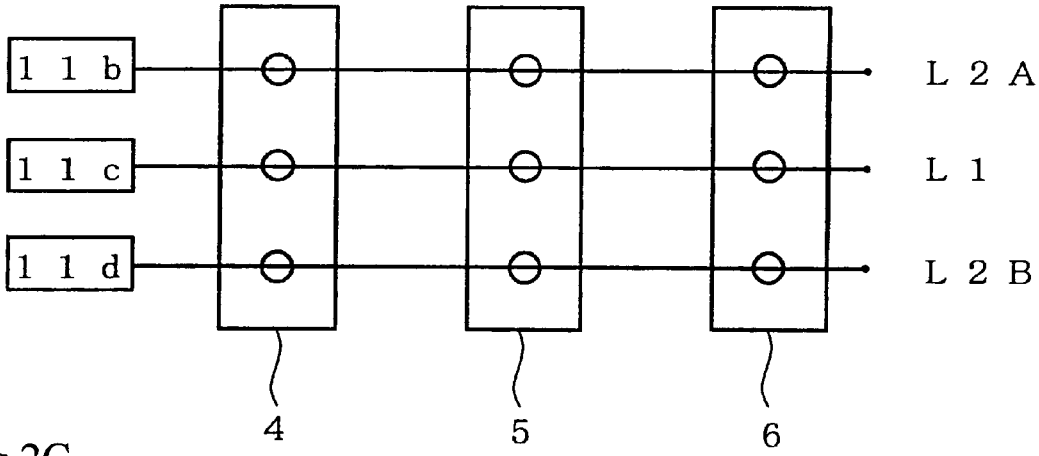

When two game coins are inserted into the slot 10, the bet number is "2". Then, in addition to the winning line L1, the winning lines L2A and L2B are activated, as shown in FIG. 2B, so that the effective line display lamps 11*b*, 11*c* and 11*d* are lighted.

Figure 2C:
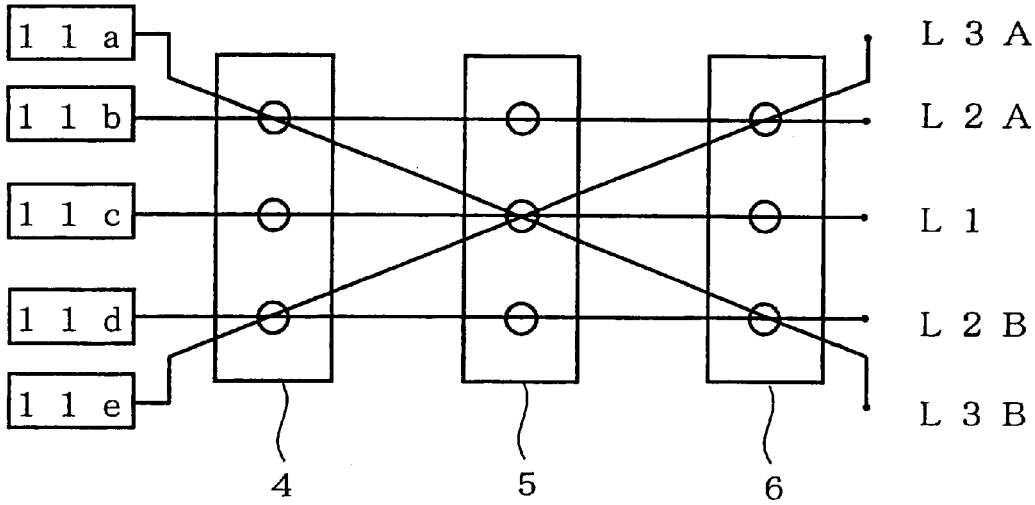

When three game coins in the maximum allowable number are inserted, the bet number is "3". Then, in addition to the three horizontal winning lines L1, L2A and L2B, the oblique winning lines L3A and L3B are also activated, as shown in FIG. 2C, so that all the effective line display lamps 11*a* to 11*e* are lighted. Here, circles in FIGS. 2A to 2C indicate the symbols which are illustrated on the individual reels 4 to 6.

On the lower lefthand side of the display window 7, there is provided one bet switch 12 or a reserved coin inserting button switch that functions as a bet number designating means. When the bet switch 12 is depressed prior to the start of each game, the bet number can be designated within the range of a credit balance without inserting a game coin into the slot 10, and the winning lines L1, L2A, L2B, L3A and L3B can be activated according to the bet number.

Here will be described the case in which the credit number of game coins is three or more and a prescribed upper limit or less (e.g., 50 or less).

One depression of the bet switch 12 by the player has the effect of inserting three game coins in the maximum allowable bet number so that the bet number is set to "3". As shown in FIG. 2C, moreover, all the winning lines Li, L2A, L2B, L3A and L3B are activated so that all the effective line display lamps 11*a* to 11*e* are lighted.

When the player depresses the bet switch 12 continuously two times, this depression has the effect of inserting two game coins so that the bet number is set to "2". As shown in FIG. 2B, moreover, the winning line L1 and the winning lines L2A and L2B are activated so that the effective line display lamps 11*b*, 11*c* and 11*d* are lighted.

When the player depresses the bet switch 12 continuously three times, this depression inserts one game coin so that the bet number is set to "1". As shown in FIG. 2A, moreover, the winning line L1 is activated so that the effective line display lamp 11*c* is lighted.

When the player depresses the bet switch 12 continuously four times, this depression is processed as if a first depression is done again. As a result, the bet number is set to "3", and all the winning lines L1, L2A, L2B, L3A and L3B are activated, as shown in FIG. 2C, so that all the effective line display lamps 11*a* to 11*e* are lighted. Each time the bet switch 12 is depressed again, the bet number is decreased by one. Each time the depression number of bet switch 12 is seven times, ten times, and so on, moreover, the same operation as that of the first depression is repeated.

Here, this repetition will be described in a more general expression. Each time the number of depressions of the bet switch 12 takes a value of Kmax X (i−1)+1 (wherein: Kmax indicates the maximum allowable bet number; and i designates a natural number), the bet number N is reset to the maximum allowable bet number Kmax. For the time period from one reset to a next reset, the bet number N is decreased by one, each time the number of depressions of the bet switch 12 increases by one.

Under the display window 7, there is mounted a credit number display 13 for displaying the number of game coins being credited at present. This display 13 is constructed of a display device of seven segment LEDs of predetermined figures.

In the upper portion of the front face of the casing 2, there is mounted a prize display 14 for displaying the number of game coins to be paid out to the prize.

In the lower portion of the front face of the casing 2, there are provided a speaker mouth 15 and a game coin payout tray 16. The speaker mouth 15 is provided for outputting various effect sounds to be emitted from a speaker mounted in the casing 2. The coin payout tray 16 is provided for reserving the game coins which are paid out from a storage hopper through a coin payout chute 17.

Under the bet switch 12, there is provided a credit/payout change switch (as will be shortly referred to as the "C/P switch") 18 for switching, when operated by the player, the play credit/payout of the game coins acquired for a prize.

Under the bet switch 12, moreover, there is provided a game start lever 19, on the righthand side of which there are arranged three stop button switches 20, 21 and 22 corresponding to the reels 4, 5 and 6, respectively.

When the player tilts and operates the game start lever 19, a game is started. By inserting a game coin into the slot 10 or depressing the bet switch 12, more specifically, at least one of the winning lines L1, L2A, L2B, L3A and L3B is make effective. When the game start lever 19 is then tilted and operated, the bet number N of game coins is fixed, and the game is started so that the reels 4, 5 and 6 start rotations altogether.

The three stop button switches 20, 21 and 22 construct variable display stop means for stopping the rotating displays of the individual reels 4, 5 and 6 for the individual columns. When the individual reels 4, 5 and 6 reach a predetermined rotational speed after the game start, the actions of the individual stop button switches 20, 21 and 22 are effected. When these effective stop button switches 20, 21 and 22 are depressed by the player, the rotations of the individual reels 4, 5 and 6 are stopped according to the depressions.

When the predetermined symbols illustrated on the individual reels 4, 5 and 6 are arrayed on an effective winning line, moreover, a prize is won so that the player acquires the game coins of a predetermined number corresponding to the combination of symbols.

Figure 3:
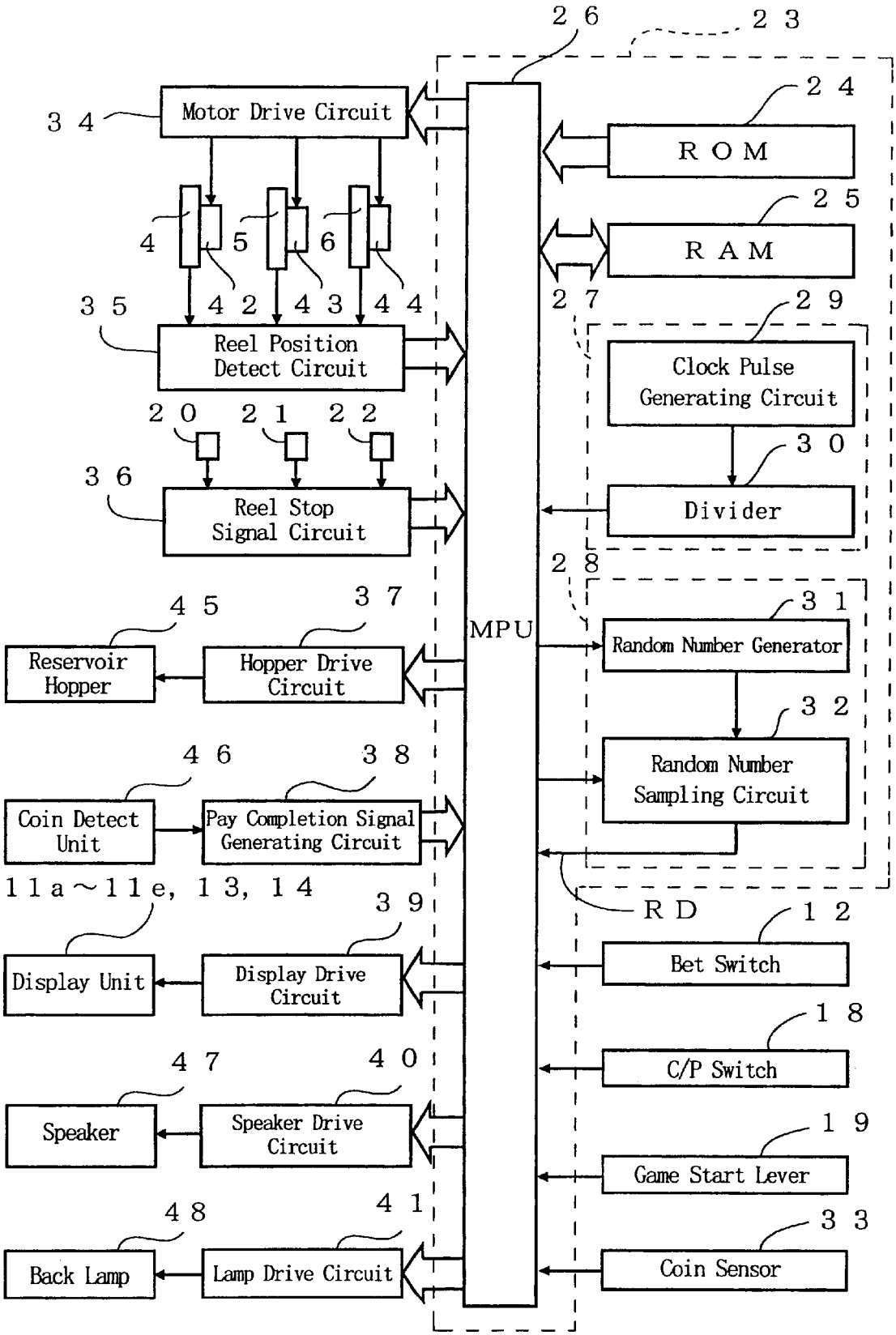
FIG. 3 is a block diagram showing a construction of a control unit of the slot machine shown in FIG. 1.

FIG. 3 shows a circuit construction including a control unit 23 for controlling the game processing operations in the slot machine 1, and peripheral devices electrically connected with the control unit 23.

As shown in FIG. 3, the control unit 23 is constructed to include: a microprocessor (MPU) 26 provided with a read only memory (ROM) 24 and a random access memory (RAM) 25; a clock circuit 27 for generating an operation clock signal of the MPU 26; and a probability setting unit 28 for setting a prize causing probability.

The ROM 24 is stored with not only a game processing procedure to be executed in the slot machine 1 as a sequence program but also a prize probability table or the like having data for determining a lottery probability.

The RAM 25 is provided with: a bet number storage region for storing the data of the bet number N; a bet flag storage region for storing a bet flag BF indicating a transitional state on whether or not the bet switch 12 is depressed; a start flag storage region for storing a start flag SF indicating a transitional state on whether or not the game start lever 19 is tilted and operated; and a storage region for storing various operation data or the like when the MPU 26 processes according to the sequence program.

The clock circuit 27 is provided with a clock pulse generating circuit 29 for generating a reference clock signal of a predetermined frequency, and a divider 30 for generating a clock signal for operating the MPU 26 by dividing the frequency of the reference clock signal.

The probability setting unit 28 is provided with a random number generator 31 for generating a random number within a predetermined range in response to a command of the MPU 26, and a random number sampling circuit 32 for sampling an arbitrary random number RD from the random numbers generated by the random number generator 31, and transferring the sampled random number RD to the MPU 26.

With a plurality of input/output ports (I/O ports) of the MPU 26, there are connected: the bet switch 12; the C/P switch 18; the game start lever 19; the coin sensor 33 for detecting the game coin inserted into the slot 10; a motor drive circuit 34; a reel position detect circuit 35; a reel stop signal circuit 36; a reserved hopper drive circuit 37; a pay completion signal generating circuit 38; a display drive circuit 39; a speaker drive circuit 40; and a lamp drive circuit 41.

With the motor drive circuit 34, there are connected stepping motors 42, 43 and 44 for driving the reels 4, 5 and 6 rotationally. These reels 4, 5 and 6 are rotated or stopped by feeding the drive pulses to the stepping motors 42, 43 and 44 or by stopping the feeds in response to a command of the MPU 26.

The reel position detect circuit 35 is provided with an optical sensor or the like for detecting the rotational positions (or rotational angles) of the reels 4, 5 and 6, so that the position detect signals detected by the optical sensor or the like are transferred from the reel position detect circuit 35 to the MPU 26.

With the reel stop signal circuit 36, there are connected with the stop button switches 20, 21 and 22. When these stop button switches 20, 21 and 22 are depressed, the reel stop signal circuit 36 detects the depression and transfers the depression detect signal to the MPU 26.

When the game start lever 19 is tilted and operated, moreover, the MPU 26 detects this tilt and commands the motor drive circuit 34 to rotate the reels 4, 5 and 6, and the reel position detect circuit 35 detects the rotational positions of the reels 4, 5 and 6 to transfer the position detect signal to the MPU 26. When the stop button switches 20, 21 and 22 are depressed after the reels 4, 5 and 6 reached predetermined rotational speeds, the depression signal is transferred from the reel stop signal circuit 36 to the MPU 26 so that the MPU 26 responds to the depression signal to cause the motor drive circuit 34 to stop the reels 4, 5 and 6.

With the reserved hopper drive circuit 37, there is connected the reservoir hopper 45 for reserving the game coins.

With the pay completion signal generating circuit 38, there is connected a coin detect unit 46. This coin detect unit 46 counts the number of game coins, as paid out for a prize from the reservoir hopper 45 to the coin payout tray 16. When the counted value of coins actually paid out reaches a predetermined prize coin number data, moreover, a pay completion signal indicating the completion of a payout is transferred from the pay completion signal generating circuit 38 to the MPU 26.

With the display drive circuit 39, there are connected the effective line display lamps 11*a* to 11*e*, the credit number display 13 and the prize display 14, so that the display lamps 11*a* to 11*e* and the displays 13 and 14 are caused to make displays in accordance with the instructions of the MPU 26.

With the speaker drive circuit 40, there is connected a speaker 47 for outputting sound effects through the speaker mouth 15. With the lamp drive circuit 41, there is connected back lamps 48 for illuminating the symbols, as appearing through the display windows 7, 8 and 9, from the back side.

Here, the sounding modes of the speaker 47 and the lighting modes of the back lamps 48 inform the player, although their details are omitted, of the proceeding situations and the prize contents of the game with the various sound effects and the blinks of the back lamps so that the player can enjoy the game.

Next, the game processing routine of the slot machine 1 by the control unit 23 at the time when game coins are to be bet by using the bet switch 12 shown in FIG. 3 will be described with reference to the flow charts of FIGS. 4 and 5.

Figure 4:
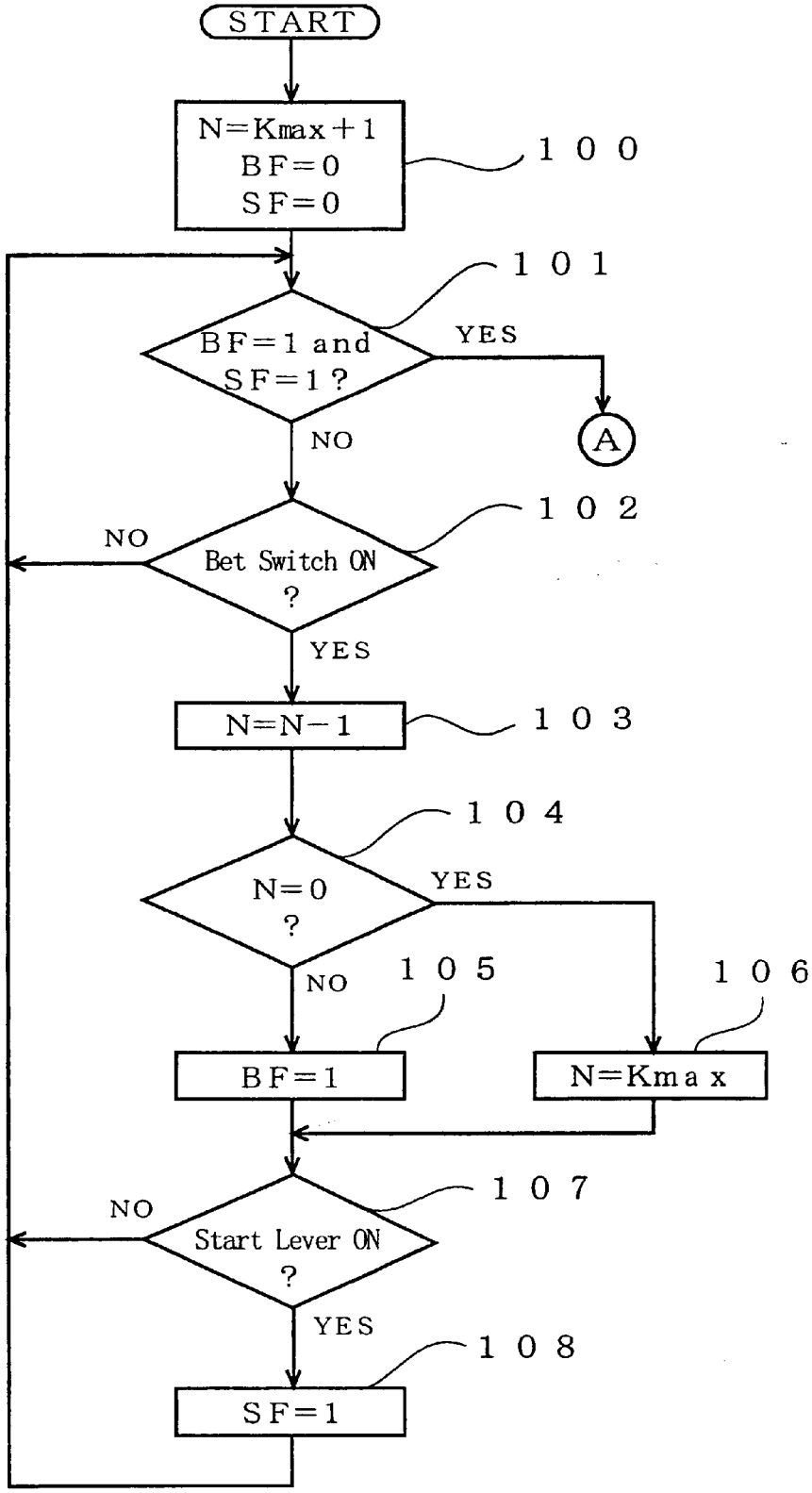
FIG. 4 is a flow chart showing a game processing routine by the control unit shown in FIG. 3.
Figure 5:
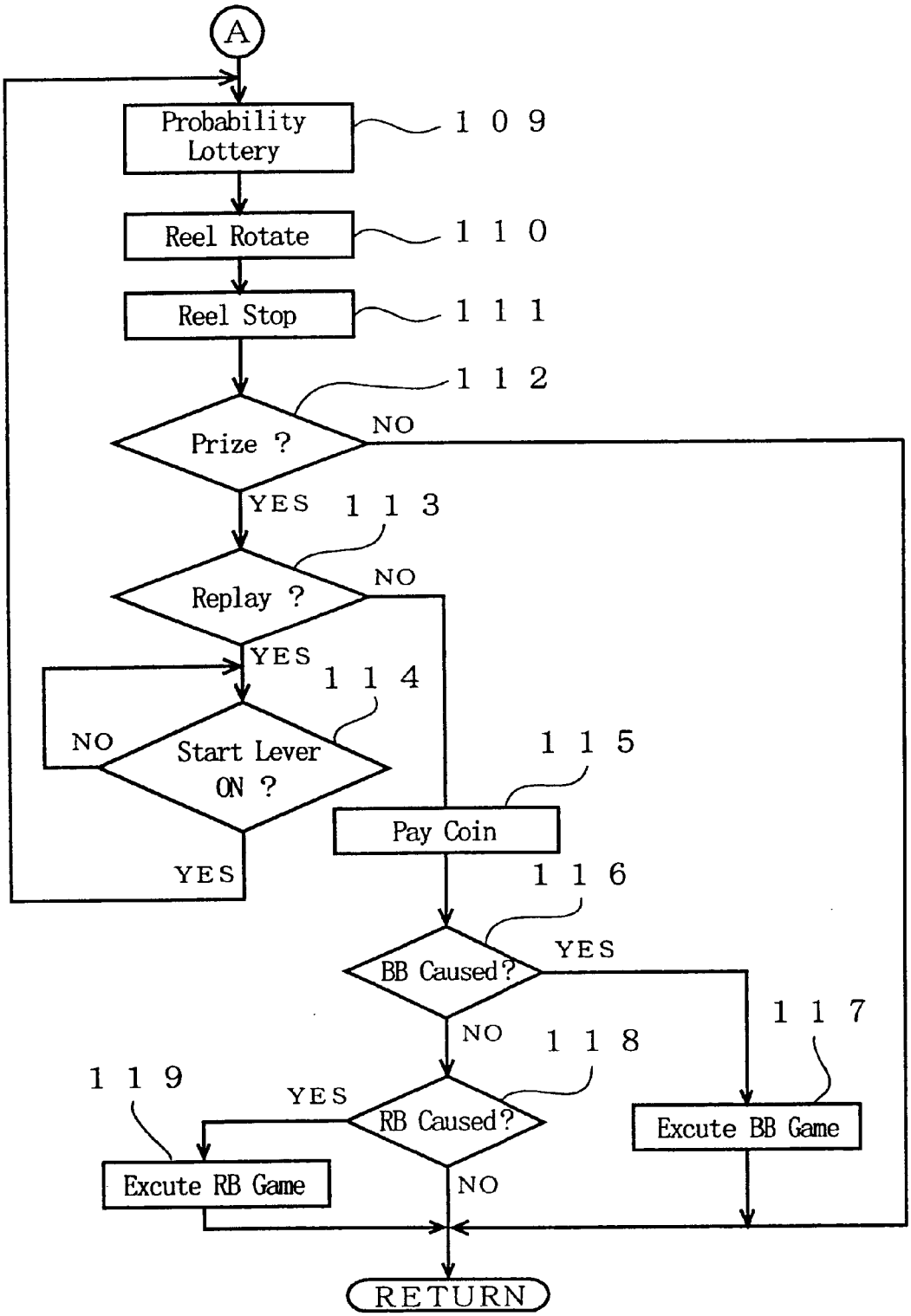
FIG. 5 is a flow chart further showing the game processing routine by the control unit shown in FIG. 3.

When one game ends and changes to a next one, as shown in FIG. 4, the routine is started from Step 100.

At Step 100, the bet number N, the bet flag BF and the start flag SF are reset in the RAM 25. Specifically: the sum (i.e., Kmax+1) of the maximum allowable bet number Kmax and 1 is stored as the bet number N in the bet number storage region; the start flag SF of the start flag storage region is set to "0"; and the bet flag BF of the bet flag storage region is set to "0". Here in this embodiment, the maximum allowable bet number Kmax for one game is determined at three.

Next, it is decided at Step 101 whether or not both the bet flag BF and the start flag SF are at 1. If both of these flags BF and SF are at "1", it is decided that the bet number N is designated by the bet switch 12 and that the game start is instructed by the game start lever 19, and the routine advances to the game operation at and after Step 109, as shown in FIG. 5. Otherwise, the routine advances to the operation of Step 102.

At Step 102, it is decided whether or not the bet switch 12 has been depressed. When the bet switch 12 is not depressed, the routine returns to Step 101 so that the decision on whether or not the bet switch 12 has been depressed is repeated at Step 101 and Step 102. If it is decided at Step 102 what the bet switch 12 has been depressed, the routine advances to the operation of Step 104 after a subtraction of 1 from the bet number N at Step 103.

At Step 104, whether or not the bet number N is at "0" is decided to determine whether or not the number of depressions of the bet switch 12 is equal to a sum of the predetermined number Kmax X (i−1)+1 (wherein: Kmax indicates the maximum allowable bet number; and i indicates a natural number). When the bet number N is not at "0", moreover, the bet flag BF is set to "1" at Step 105, and the routine advances to the operation of Step 107. When the bet number N is at "0", it is set to the maximum allowable bet number Kmax at Step 106, and the routine advances to the operation of Step 107.

After these operations of Steps 104 to 106, the depression of the bet switch 12 is processed as the first depression each time the number of depressions of the bet switch 12 falls on the predetermined value of Kmax X (i−1)+1, to that the bet number N is reset to the maximum allowable bet number Kmax corresponding to the first depression.

Next, it is decided at Step 107 whether or not the game start lever 19 has been tilted and operated. When this lever 19 is not tilted, that is, when the answer is "NO", the operations from Step 101 are repeated. When the lever 19 is tilted, that is, when the answer is "YES", the start flag SF is set to "1" at Step 108, and the routine returns to the operation of Step 101.

According to the processing routine of Steps 100 to 108 thus far described, the bet number N takes the maximum bet number "Kmax" when the bet switch 12 is depressed one time (or Kmax X (i−1)+1 times, wherein i indicates a natural number) before the game start lever 19 is operated. The bet number N takes the value "2" when the bet switch 12 is depressed two times (Kmax X (i−1)+2 times, wherein i indicates a natural number). The bet number N takes the value "1" when the bet switch 12 is depressed three times (or Kmax X (i−1)+3 times, wherein i indicates a natural number). Moreover, these operations of Steps 100 to 108 are repeated until the game start lever 19 is tilted, and the bet number N is set within the range from the maximum bet number "Kmax" to "1" even if the number of depressions of the bet switch 12 exceeds the maximum bet number Kmax.

By the display drive circuit 39, on the other hand, the effective line display lamps 11*a* to 11*e* are lighted according to the bet number N.

Next, the game processing operations at and after Step 109 will be described with reference to FIG. 5. At Step 109, the bet number N, as designated by the player, is fixed. The coins corresponding to the bet number N are consumed from the credited game coins, and the probability is then determined. In this probability lottery, the MPU 26 generates a random number in the random number generator 31 and inputs the random number RD, as sampled by the random number sampling circuit 32, to decide the prize mode corresponding to the bet number N and the random number RD, on the basis of the prize probability table shown in FIG. 6.

The prize probability table is stored with: numerical data a1 to g2 corresponding to the case in which the bet number N is at "1"; numerical data a2 to g2 corresponding to the case in which the bet number N is at "2"; and numerical data a3 to g3 corresponding to the case in which the bet number N is at "3", that is, the maximum allowable bet number "Kmax". These numerical data have magnitude relations of a1<b1<c1<d1<e1<f1<g1, a2<b2<c2<d2<e2<f2<g2, and a3<b3<c3<d3<e3<f3<g3, so that the individual prize modes of a big bonus (BB) game, a regular bonus (RB) game, a small bonus game, a replay and a blank are determined according to the individual numerical ranges. For the small bonus hits, moreover, four kinds of prize modes corresponding to the symbols illustrated on the reels 4, 5 and 6 such as "small hit of watermelon", "small hit of bell" and "small hits of cherry" are determined.

For the individual bet numbers N, more specifically: the "BB game" is determined if the relation between the random number RD and the aforementioned numerical data is RD<a; the "RB game" if a≦RD<b; the "small hit of watermelon" if b≦RD<c; the "small hit of bell" if c<RD<d; the "small hit of 4 cherry" if d≦RD<e; the "small hit of 2 cherry" if e≦RD<f; the "replay" if f≦RD<g; and the "blank" if g≦RD.

Thus, at Step 109, one prize corresponding to the random number RD is determined from totally eight kinds of symbol combination modes for the different prizes, as including the "blank", and its information is stored in the predetermined storage region of the RAM 25.

When a prize mode is determined, the reels 4, 5 and 6 are rotationally driven altogether at Step 110 by the motor drive circuit 34 and the stepping motors 42, 43 and 44. Next, when the stop button switches 20, 21 and 22 are depressed at the instant the reels 4, 5 and 6 take the predetermined rotational speed, the reels 4, 5 and 6 are stopped at Step 111 by stopping the drives of the stepping motors 42, 43 and 44 by the motor drive circuit 34. Moreover, the reel position detect circuit 35 detects the stop positions of the reels 4, 5 and 6 so that the MPU 26 judges the positional relations between the individual symbols of the reels 4, 5 and 6 and the effective winning lines on the basis of the detected data.

At next Step 112, it is decided whether or not the positional relations between the individual symbols and the effective winning lines correspond to the prize modes set at Step 109. If this answer is NO, the routine of one game is ended. If the positional relations correspond to the prize modes set at Step 109, on the contrary, it is decided at Step 113 whether or not the prize mode is the "replay". If this answer is YES, it is decided at Step 114 whether or not the game start lever 19 has been operated again. If this answer is YES, another game is played by repeating the operations from Step 109.

If the "replay" is denied at Step 113, the reservoir hopper 45 is driven at Step 115 so that the game coins in the predetermined number corresponding to the prize are paid out from the reservoir hopper 45 to the coin payout tray 16. Alternatively, the number of credit to be stored in the coin reservoir means is increased in place of the coin payout.

At next Step 116, it is decided whether or not the prize mode corresponds to the "BB game". If other than the "BB game", the routine advances to the operation of Step 118. If the prize mode falls in the "BB game", this BB game is executed at Step 117.

At next Step 118, it is decided whether or not the prize mode corresponds to the "RB game". If other than the "RB game", one game is ended. If the prize mode falls in the "RB game", this RB game is executed at Step 119.

Thus, in this embodiment, when the bet switch 12 or the bet number designating means is depressed at first, the bet number N is set to the maximum allowable bet number "Kmax". As the number of depressions of the bet switch 12 increases, moreover, the bet number N gradually decreases. As a result, the embodiment can match the intention of the player who is going to enter a game by designating the maximum allowable bet number, while lightening the burden on the player.

Each time the number of depressions of the bet switch 12 exceeds the maximum allowable bet number Kmax, this excess is processed as if the bet switch 12 were depressed for the first time. Even if the bet number N is changed or if the bet is mistaken, therefore, an easy countermeasure can be provided for the player.

Here in this embodiment, when the player depresses the bet switch 12 continuously a number of times so that the residual of the credit falls below the maximum allowable bet number "3", the bet number "2" or "1" may be designated as the maximum allowable bet number "Kmax" apparently in a series of depressions, but the maximum allowable bet number Kmax is still designated preferentially. This allows the player to depress the bet switch 12 while recognizing that he can designate the maximum allowable bet number Kmax preferentially. Therefore, this embodiment sets the bet number while conforming to the intention of the player.

In the game machine of the prior art provided with one bet switch, on the contrary, the minimum bet number "1" is set when the bet switch is depressed at first, and the bet number is sequentially counted up as the number of depressions increases. Therefore, the player depresses the bet switch while recognizing that the minimum bet number "1" is preferentially set. Thus, in the game machine of the prior art, no consideration is taken regarding the intention of the player to start the game by designating the maximum allowable bet number. On the contrary, this embodiment can provide an excellent operability that matches the intention of the player.

In this embodiment, moreover, the bet number is set exclusively by the single bet switch 12 so that the number of parts of the slot machine 1 can be reduced.

Here, this embodiment has been described in the case in where the bet number designating means is exemplified by the push button type bet switch. However, the bet number designating means may be modified into another type such as a falling type switch.

Although the invention has been described on the embodiment of the slot machine, on the other hand, it should not be limited thereto but could be applied to other game machines in which game media are bet on the credit. This application to other game machines could provide effects similar to the foregoing ones.

Although the invention has been described on the embodiment in which the maximum allowable bet number Kmax is set at "3", on the other hand, it should not be limited thereto but could be applied to other game machines in which the maximum allowable bet number Kmax is set at a value other than "3".

When the credit residual number becomes "2" or "1" as the game proceeds, moreover, it could naturally be detected, as described hereinbefore, to set the maximum allowable bet number to "2" or "1". In the continuous depressions of the bet switch 12, on the other hand, the bet number could be set to "0" with the number of depressions just before the number of times at which the depression is processed assuming that the first depression is performed again.

In this embodiment, on the other hand, the bet number decreases by one for each number of depression. However, the invention should not be limited thereto, but the bet number could be decreased by two or three for each number of depression.

Although the present invention has been explained in reference to the embodiments, it is apparent for those skilled in the art that many changes and modifications can be made without departing from the spirit and scope of the invention, as clear from the following claims.

What is claimed is:

1. A game machine enabling a player to designate a bet number within a range of a predetermined maximum allowable bet number, comprising:

a game start lever operated by the player for starting a game;

a bet number designating button switch generating a signal when operated by the player, said game machine having only one bet number designating button switch; and control means for setting said bet number to said maximum allowable bet number for each game in response to receiving only one signal for each game by the first operation of said bet number designating button switch before the game start lever is operated to start each game.

2. A game machine according to claim 1, wherein said control means decreases the bet number which is set in response to the one operation of said bet number designating button switch, each time the number of operations of said bet number designating button switch increases.

3. A game machine according to claim 2, wherein, in said each game, said control means decreases the bet number, which has been set in response to the one operation of said bet number designating button switch, each time the number of operations of said bet number designating button switch increases, and sets said bet number again to said maximum allowable bet number when said operation number reaches a predetermined value, to repeat the operation to decrease the bet number each time the operation number of said bet number designating button switch increases.

4. A game machine according to claim 3, wherein said maximum allowable bet number is set in relation to the number of residuals reserved by coin reservoir means.

5. A game machine according to claim 4, wherein said maximum allowable bet number is 3 and is set to 2, when the number of residuals is 2, and to 1 when the residual number is 1.

6. A game machine according to claim 3, wherein said control means decreases the bet number, which has been set in response to the one operation of said bet number designating button switch, by one each time the operation number of said bet number designating button switch increases, to set said bet number within a range from the maximum allowable bet number to 1.

7. A game machine according to claim 3, wherein said control means decreases the bet number, which has been set in response to the one operation of said bet number designating button switch, by one each time the operation number of said bet number designating button switch increases, to set the bet number to 0 at the operating time of said bet number designating means just before the bet number is reset to the maximum allowable bet number, thereby to set said bet number within a range from the maximum allowable bet number to 0.

8. A game machine according to claim 3, wherein said game machine is a slot machine.

9. A game machine according to claim 2, wherein said control means decreases the bet number which has been set in response to the one operation of said bet number designating button switch, by two or three each time the operation of said bet number designating button switch increases.

* * * * *